US006170683B1

(12) United States Patent
Montgomery

(10) Patent No.: US 6,170,683 B1
(45) Date of Patent: Jan. 9, 2001

(54) TWO STAGE DISPENSING CAP FOR PRESSURIZED CONTAINERS

(75) Inventor: Gary V. Montgomery, Evansville, IN (US)

(73) Assignee: Rexam Medical Packaging Inc., Evansville, IN (US)

( * ) Notice: Under 35 U.S.C. 154(b), the term of this patent shall be extended for 0 days.

(21) Appl. No.: 09/440,973

(22) Filed: Nov. 16, 1999

(51) Int. Cl.[7] ..... B65D 47/08

(52) U.S. Cl. ..... 215/235; 215/225; 215/238; 215/303; 215/307; 220/263; 220/291; 222/556

(58) Field of Search ..... 215/235, 225, 215/224, 223, 201, 237, 238, 243, 321, 303, 307; 220/259, 255, 263, 291, 292, 810, 831, 827; 222/153.14, 570, 153.06, 556, 520, 548

(56) References Cited

U.S. PATENT DOCUMENTS

| | | | |
|---|---|---|---|
| 2,133,490 | | 10/1938 | Swannell . |
| 2,466,295 | | 4/1949 | Algier . |
| 2,961,119 | | 11/1960 | Leach . |
| 3,623,622 | | 11/1971 | Sullivan . |
| 4,231,486 | | 11/1980 | Bock . |
| 4,394,918 | | 7/1983 | Grussen . |
| 4,427,126 | | 1/1984 | Ostrowsky . |
| 4,534,479 | | 8/1985 | Conti . |
| 4,726,482 | | 2/1988 | Barriac . |
| 4,778,069 | | 10/1988 | Keller . |
| 4,887,747 | | 12/1989 | Ostrowsky et al. . |
| 4,941,580 | | 7/1990 | Julian . |
| 4,986,430 | | 1/1991 | Dutt . |
| 4,993,570 | | 2/1991 | Julian et al. . |
| 5,065,911 | | 11/1991 | Rohr et al. . |
| 5,076,453 | | 12/1991 | Odet . |
| 5,163,571 | | 11/1992 | Mouni . |
| 5,305,900 | * | 4/1994 | Maguire et al. ..... 215/307 X |
| 5,314,093 | | 5/1994 | Gross et al. . |
| 5,356,025 | | 10/1994 | Renault . |
| 5,402,900 | | 4/1995 | Glynn . |
| 5,533,633 | | 7/1996 | King . |
| 5,593,054 | * | 1/1997 | Glynn ..... 215/225 |
| 5,740,933 | * | 4/1998 | Conti et al. ..... 215/224 X |
| 5,779,072 | | 7/1998 | Kress . |
| 5,785,196 | | 7/1998 | Montgomery et al. . |
| 5,829,609 | * | 11/1998 | Beck ..... 215/224 X |
| 5,875,907 | | 3/1999 | Lay . |
| 5,875,942 | | 3/1999 | Ohmi et al. . |

* cited by examiner

*Primary Examiner*—Nathan J. Newhouse
(74) *Attorney, Agent, or Firm*—John F. Salazar; Middleton & Reutlinger

(57) ABSTRACT

A two stage dispensing cap for a carbonated beverage container is described. The cap has a flip top which is hingedly connected to a collar wherein the collar is rotatable on the container. The cap, upon rotation of the collar, is first opened into a venting position wherein the flip top vents the pressurized contents of the container but remains locked partially closed. Continued rotation of the cap releases the locked flop top to allow the container to be fully opened. A set of cams on the container neck work in conjunction with annular beads to first allow partially opening of the flip top into the venting position and then allowing it to fully open.

42 Claims, 14 Drawing Sheets

TWO STAGE DISPENSING CAP FOR PRESSURIZED CONTAINERS

BACKGROUND OF THE INVENTION

1. Field of the Invention

The present invention relates to closures and particularly to a double latch flip seal closure which is utilized in conjunction with a carbonated beverage and container.

2. Discussion of the Prior Art

Flip top closures are fairly well known in the art. However, typical flip top closures incorporate a biased hinge and stationary base portion wherein the flip top portion of the closure is pushed forward by the biasing action of the hinge forcing the flip top up and away from the base portion of the closure. Further, most prior art flip top closures will not work appropriately with carbonated beverages as the contents are held under considerable pressure.

Other threaded closure are also fairly well known in the art for use with carbonated beverages. However, as is fairly well known, one of the drawbacks with use of standard threaded closures on carbonated beverages is a complete removal of the closure from the container thus allowing the closure to be lost after removal. An additional problem known with standard threaded closures on carbonated beverage containers is the venting of the gas from the beverage upon initial unthreading of the closure in that control of the venting is unattainable using traditional treaded closures. Further, adequate sealing of the container may be a problem in standard threaded closures since a definitive seal between the container mouth and closure top wall may be inadequate to properly keep the high pressure contents.

Of the known prior art, U.S. Pat. No. 4,941,580 discloses a flip top dispensing closure having a base ring which is rotatable. As is shown in some of the embodiments, rotation causes opening of a lid which is hingedly connected to the base ring. However, this closure lacks many fundamental aspects of a flip top closure necessary for use with carbonated beverages and does not adequately provide a mechanism for two stage opening of the container. Further, when the flip top closure is placed in the open position, the opening structure prevents the flip top from being closed in that position thereby preventing immediate closing and possibly confusing the user.

The prior art therefore is lacking in a double latch flip top closure which has a rotatable base allowing the flip top to be actuated by rotation of the base portion in a manner suitable for use in conjunction with carbonated beverage containers.

SUMMARY OF THE INVENTION

It is therefore been desired to provide a double latch flip top closure which is available for use in conjunction with carbonated beverage containers. It is accordingly an object of the present invention to provide such a flip top closure which is a two-piece closure having a double staged opening process and which is suitable for use with carbonated beverages under high pressure. Typically, closures that are utilized on containers having carbonated beverages contained therein must provide adequate sealing for high pressure containment. Such objective is difficult to meet utilizing commonly known prior art flip top dispensers. The two-piece flip seal for carbonated beverages of the present invention meets this objective.

Another object of the present invention is to provide a double latch flip top closure which allows the user to vent the gas from within the container prior to fully opening the container. Additionally, an object of the present invention is to provide a double latch closure which allows the flip top to be closed when at the same location on the container rotationally that it has been opened, thus allowing the flip top to be fully opened and closed along the same circumferential point on the container neck.

An additional object of the present invention is to provide a double latch dispensing closure for utilization with pressurized containers wherein the flip top portion of the cap has a biased hinge which forces the flip top cap into the open or closed position.

An additional object of the present invention is to provide a two-stage dispensing cap for pressurized containers wherein the flip top has an annular plug seal for tight sealing of the flip top with the container.

It is a further object of the present invention to provide a flip top closure which has adequate tamper-indicating means located thereon such that upon first use of the two-stage dispensing cap, visual means are provided indicating prior use.

A further object of the present invention is to provide a two-stage dispensing cap for utilization with pressurized containers wherein the dispensing cap remains permanently attached to the neck of the container, but is rotatable thereon.

It is an additional object in conjunction herewith to provide a two-stage dispensing closure which provides primary lugs for activation of the flip top upon initial rotation of the closure and which further provides for complete opening of the flip upon continued rotation of the collar for the closure.

A further object of the present invention is to provide a two stage dispensing cap for attachment to a container, comprising a collar rotatably affixed to said container, a flip top hingedly connected to said collar having a top wall and a depending side wall, said side wall having a lifting lug and a lid retaining lug co-aligned on the interior thereof, said lifting lug above said lid retaining lug, wherein said container further has an upper bead and a lower bead directly therebelow, a primary upper cam and a primary lower cam, said primary upper cam co-aligned with said primary lower cam, said primary upper cam extending upward from the upper surface of said upper bead, said primary lower cam extending downward from said lower bead, and further having a secondary cam, said secondary cam extending downward from said upper bead and located rotationally past said primary cams.

All of the above-outlined objectives are met by the two-stage, double latch flip top dispensing closure for pressurized containers described herein.

BRIEF DESCRIPTION OF THE DRAWINGS

A better understanding of the invention will be had upon reference to the following description in conjunction with the accompanying drawings in which like numerals are referred to like parts and wherein.

DETAILED DESCRIPTION OF THE PREFERRED EMBODIMENT

Figure 1:
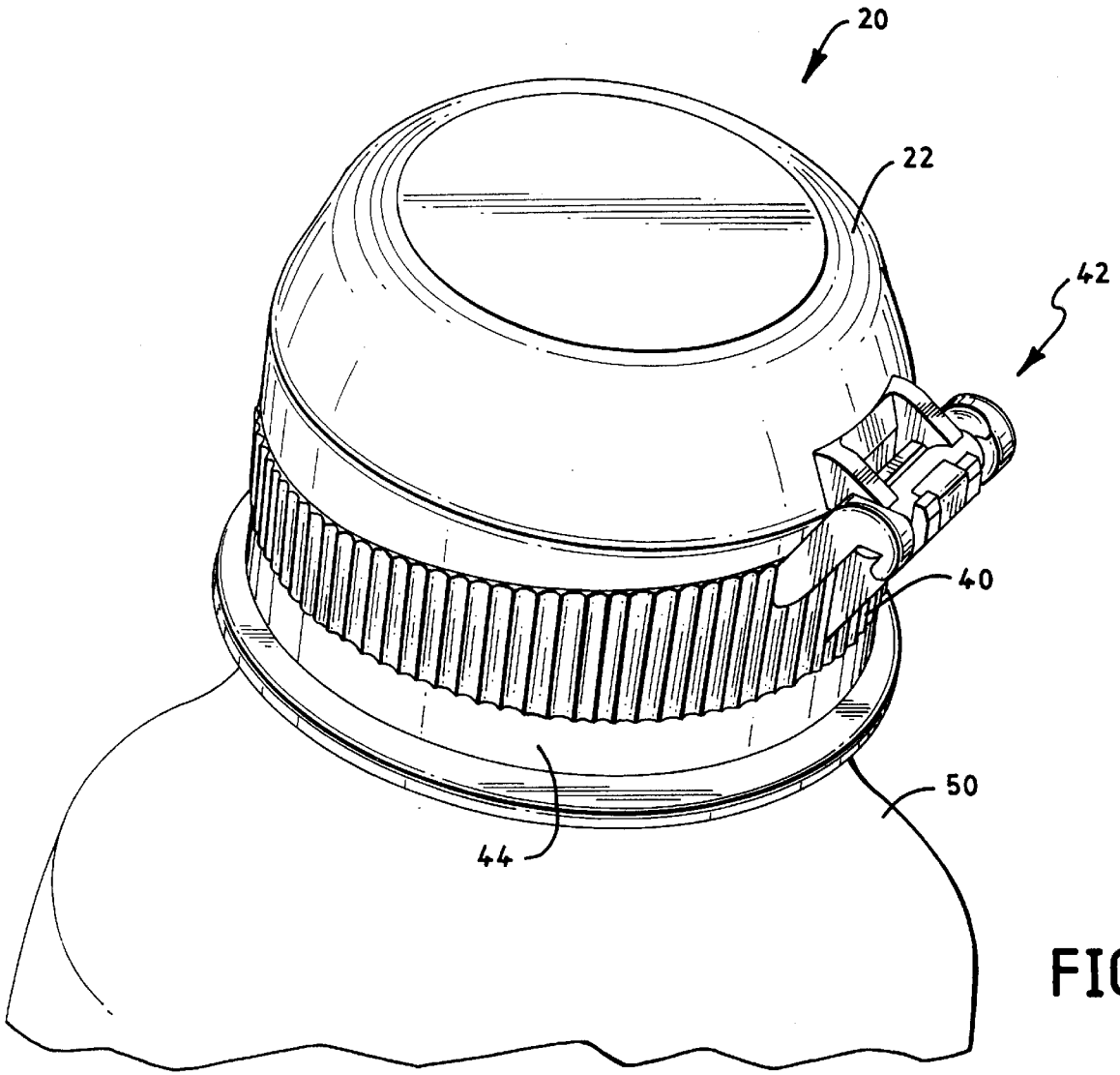
FIG. 1 is a perspective view of the two-stage double latch dispensing cap for pressurized containers of the present invention.

The two-staged double latch dispensing cap 20 for pressurized containers is depicted in FIG. 1. The dispensing cap 20 is comprised of an upper flip top portion 22 and a lower collar portion 40 which are combined together and retained upon the neck of container 50 and rotatable thereon. The two-stage dispensing cap 20 described herein is particularly designed for use in combination with containers which hold pressurized beverages such as carbonated beverages. However, the dispensing cap 20 may also be used with non-carbonated fluids as the typical filling process for such beverages includes a gas to pressurize the container after filling. The cap 20 of the present invention is uniquely designed for use in conjunction with such a pressurized container so that the flip top 22 does not separate from the collar 40 upon initial opening of the cap. The flip top 22 of the cap 20 is opened upon rotation in the counter-clockwise direction of the dispensing cap 20 thereby causing the flip top 22 to partially open venting pressurized air held within the container 50. Continued counter-clockwise rotation of the collar 40 will cause the flip top 22 to be removed from the mouth container 50 while retained to the collar 40 via hinge 42. The dispensing cap 20, as is shown in FIG. 1, thereby requires a first and second opening mechanism for allowing the venting of the container without the flip top 22 being completely released from the mouth of the container 50 combined with the second stage caused by further rotation of the cap 20 forcing the flip top 22 up and away from the mouth of the container. The flip top portion 22 thereby rotates about the hinge 42 while being retained to collar 40. Further, a tampering indicating feature 44 may be utilized on the two-stage dispensing cap 20 of the present invention for indication of prior rotational opening.

Figure 2:
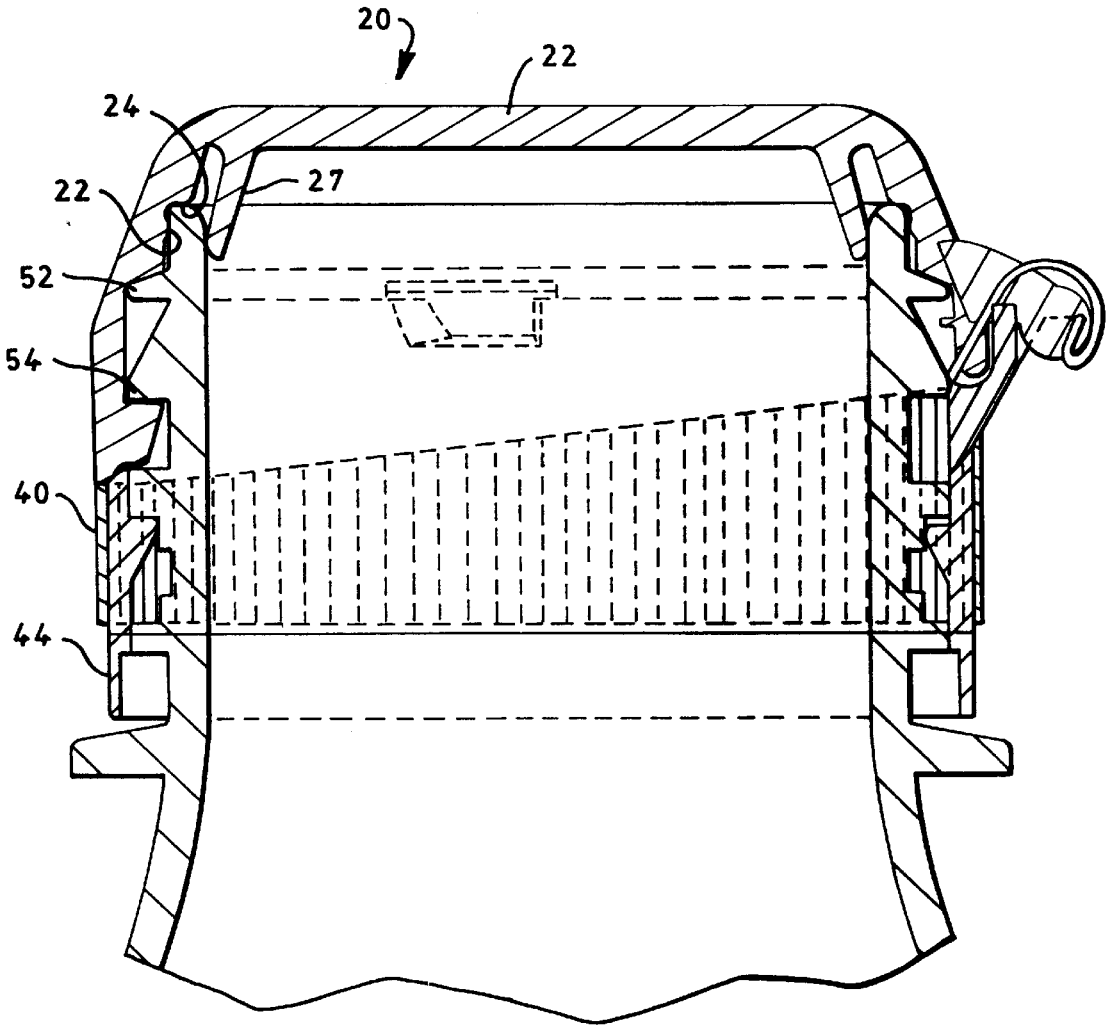
FIG. 2 is side sectional side view of the dispensing cap depicted in FIG. 1.
Figure 7:
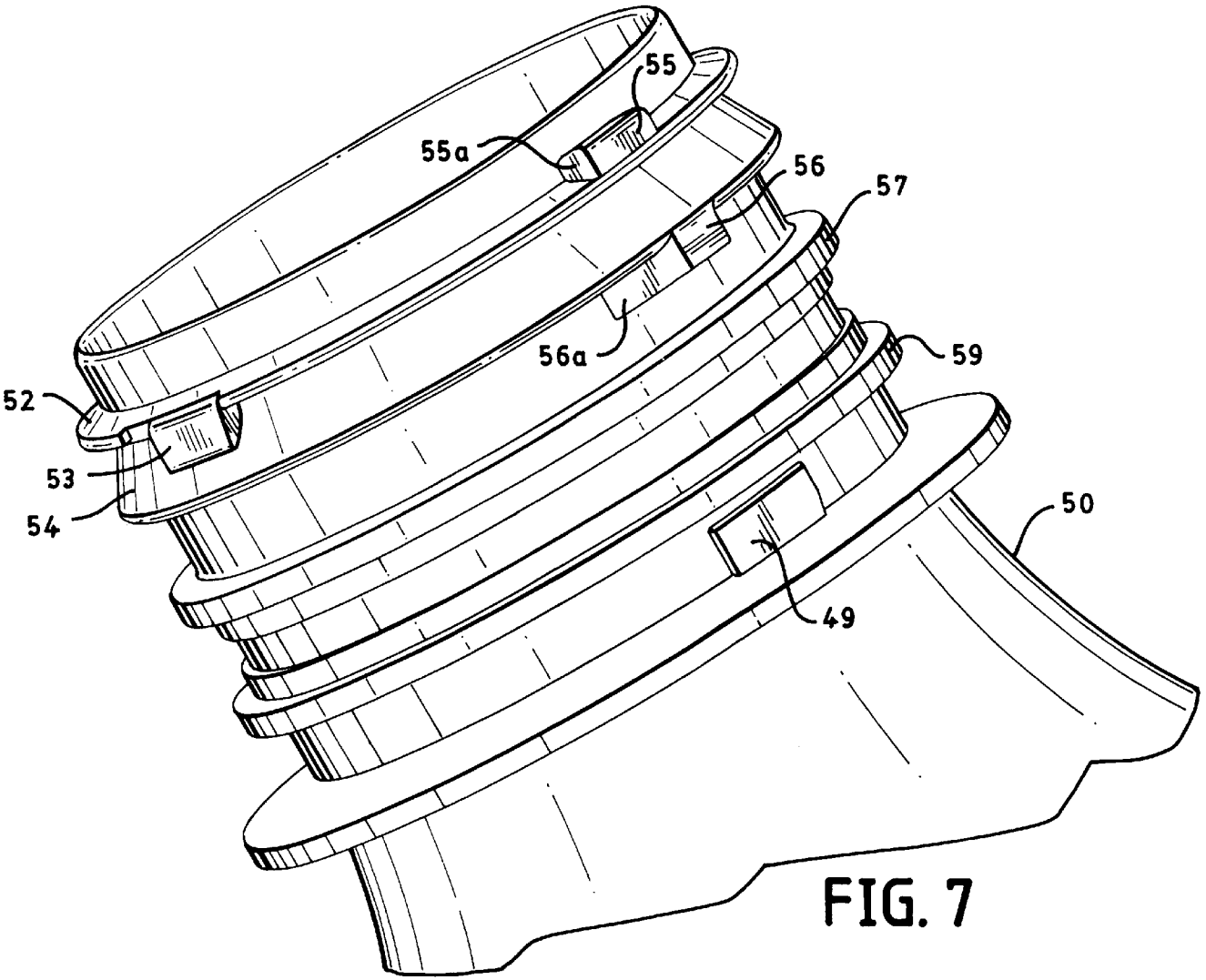
FIG. 7 is a perspective view of the container on which the dispensing cap, shown in FIG. 1 is attached.
Figure 8:
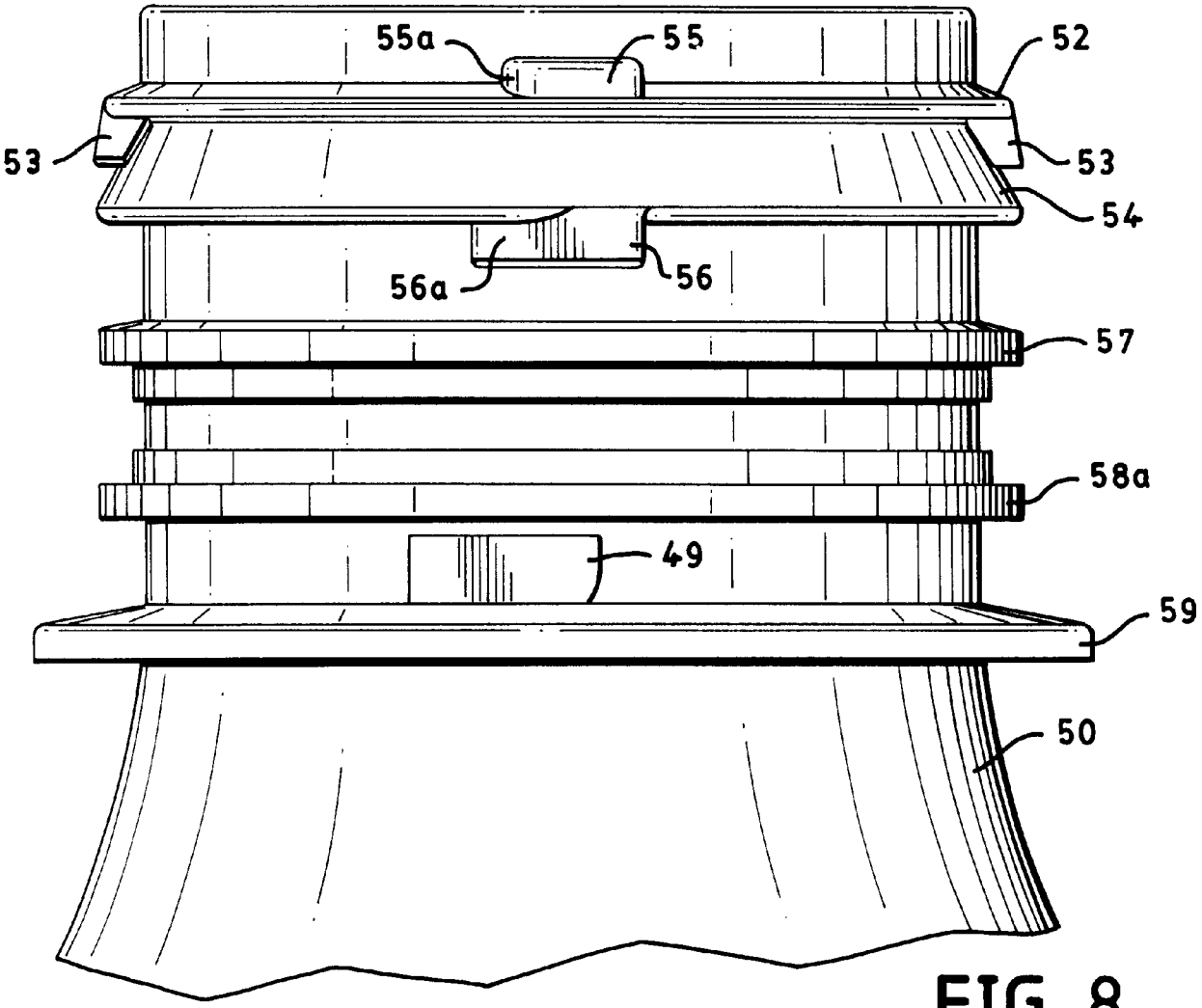
FIG. 8 is a side view of the container shown in FIG. 7.

As partially shown in FIG. 2 in conjunction with FIG. 7 and FIG. 8, the two-stage dispensing cap for pressurized container 20 of the present invention is used in combination with a specialized container 50 which has three separately identifiable beads formed thereon working in conjunction with the dispensing cap 20. Annular upper bead 52 is provided along the upper portion of the container neck which is directly adjacent and above annular lower bead 54. Below said lower bead 54 is retaining bead 57 which firmly holds collar 40 and thus the cap 20 on the neck of container 50. Finally, annular tamper indicating or TI bead 58 is located below the retaining bead 57, TI bead 58 holding the tamper indicating band, if one is used, to the container neck once separated from the dispensing cap 20.

Upper bead 52 is depicted as fairly narrow while, lower bead 54 has a more chamfered profile and is located directly there below. Both beads 52 and 54 are slightly angled on the downward direction such that their upper surfaces aid in the re-closing of the cap 20 onto container 50. Downward pressure may be utilized to snap the entire cap 20 over the beads and firmly onto the neck of container 50. Additionally, retaining bead 57 is further shown below said lower bead 54. Lower bead 54 utilizes a more chamfered profile as it is the main locking bead holding the flip top closed in the fully sealed position by retaining lug 28 below the lower edge of bead 54.

In addition to the construction of the beads on the neck of container 50 are primary cams 55 and 56 as well as secondary cam 53, shown in FIG. 7. The two stage latching action for the dispensing cap 20 of the present invention is caused by interaction of the lifting lug 29 on upper cam 55 when the cap 20 is rotated. Primary upper cam 55 acts to force the flip top 22 partially upward in order to vent the pressurized contents of the container 50 without fully releasing the flip top. Primary lower cam 56 deforms the flip top 22 in the outward direction by cooperating with the lid retaining lug 28 shown in FIG. 2. Flip top 22 at this stage is thus partially opened with lid retaining lug 28 locked underneath upper bead 52 preventing the complete opening of the flip top 22.

Secondary cam 53 completes the opening process of the flip top 22 after continued counter clockwise rotation of the collar 40 by forcing the lid retaining lug 28 over the upper bead 52. As is readily apparent from FIG. 2 and FIG. 9, retaining bead 57 combines with retaining collar 40 through retainer lugs 48, more clearly shown in FIG. 5, in order to allow easy rotation of collar 40 through on the neck of container 50 while firmly retaining the collar 40 and therefore the flip top 22 thereon. A further discussion of the interaction between primary upper cam 55, primary lower cam 56, secondary cam 53, upper bead 52, lower bead 54 and the lugs formed on the inner side wall of the flip top 22 will be discussed below.

Figure 4:
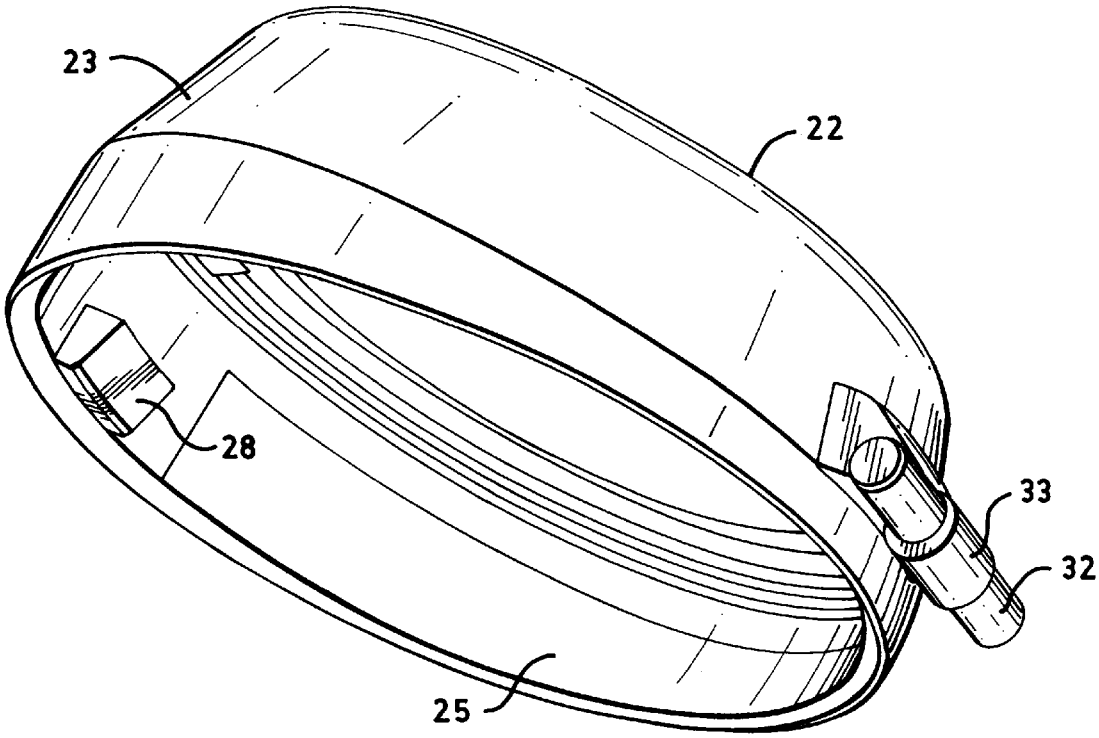
FIG. 4 is an additional perspective view of the flip top shown in FIG. 3.
Figure 5:
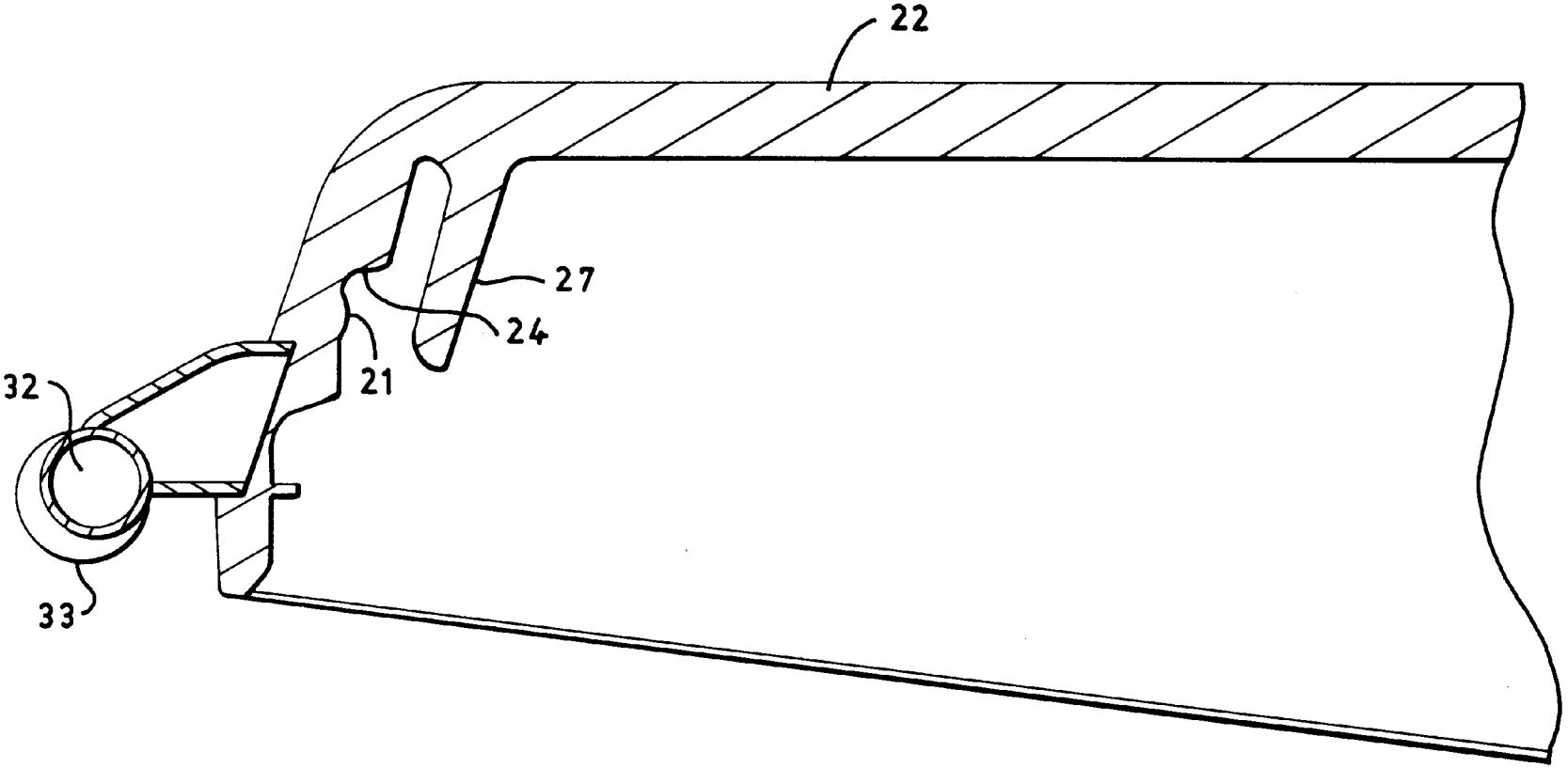
FIG. 5 is an enlarged partial cross sectional view of the hinge area for the flip top shown in FIG. 4.
Figure 6:
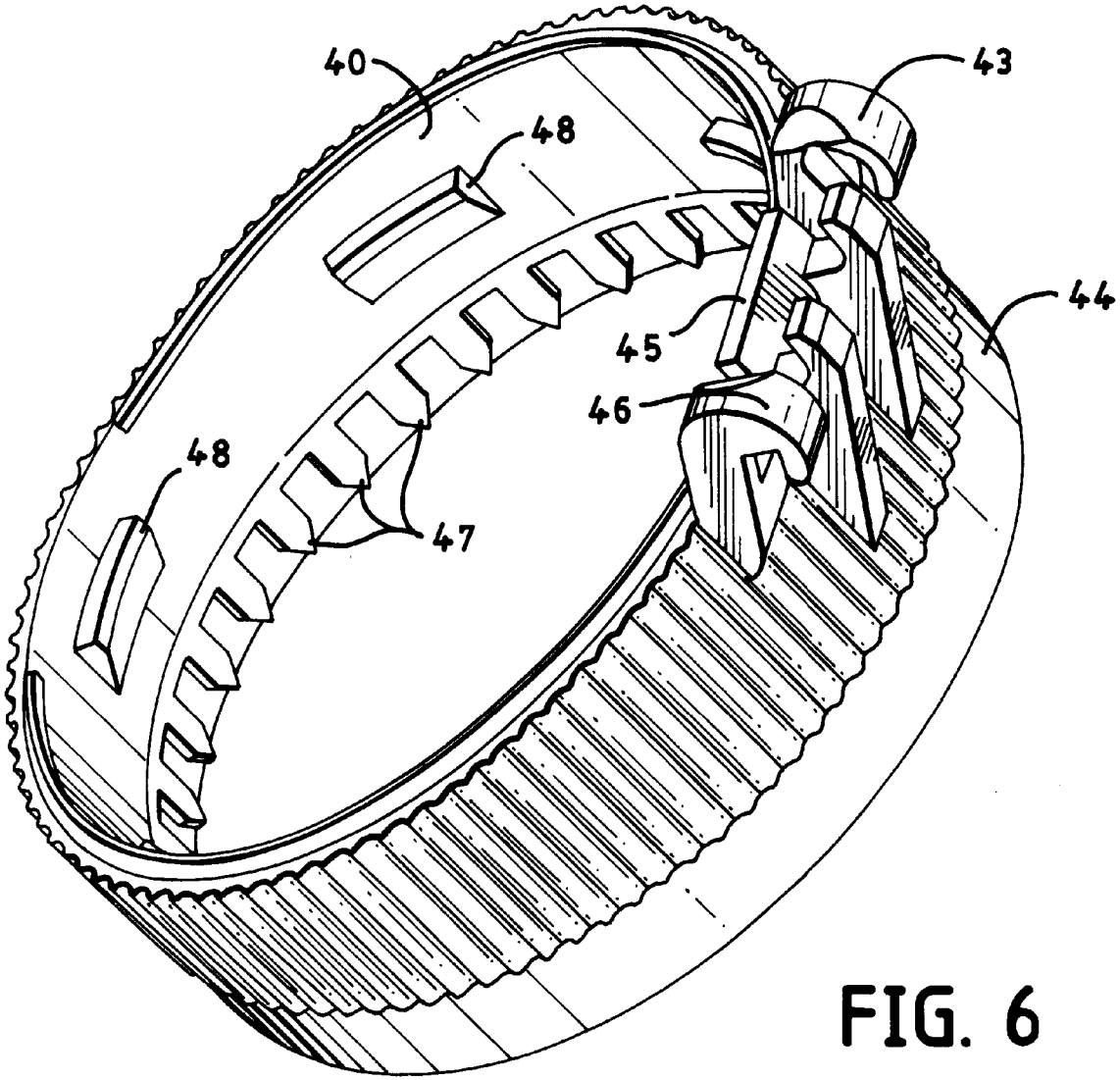
FIG. 6 is a perspective view of the collar portion of the dispensing cap for the present invention which is shown in FIG. 1.

Flip top 22 is further comprised of hinge post 32 which is rotatably received and retained within first hinge arm 43 and second hinge arm 46 of collar 40, shown in FIG. 6. The hinge post 32 of the flip top 22 has centrally located thereon a hinge eccentric 33 in order to bias the flip top 22 in the open or closed direction. The eccentric 33, more clearly depicted in FIG. 4 and 4*a*, reacts with the hinge biasing tab 45 formed in between the first hinge arm 43 and second hinge arm 46 along the top edge of collar 40. Thus, the flip top 22 is biased by the action of the tab 45 on eccentric 33 biasing the flip top in the open or closed position. As can be seen in FIG. 5, the eccentric 33 expands slightly along an arc from approximately 90° moving clockwise to approximately 220° with the widest point being half way therethrough. By forming the eccentric in such a tapered arc, proper biasing of the hinge allows for compression of biasing tab 45 on the hinge when the flip top 22 is not in the proper open or closed position.

Figure 3:
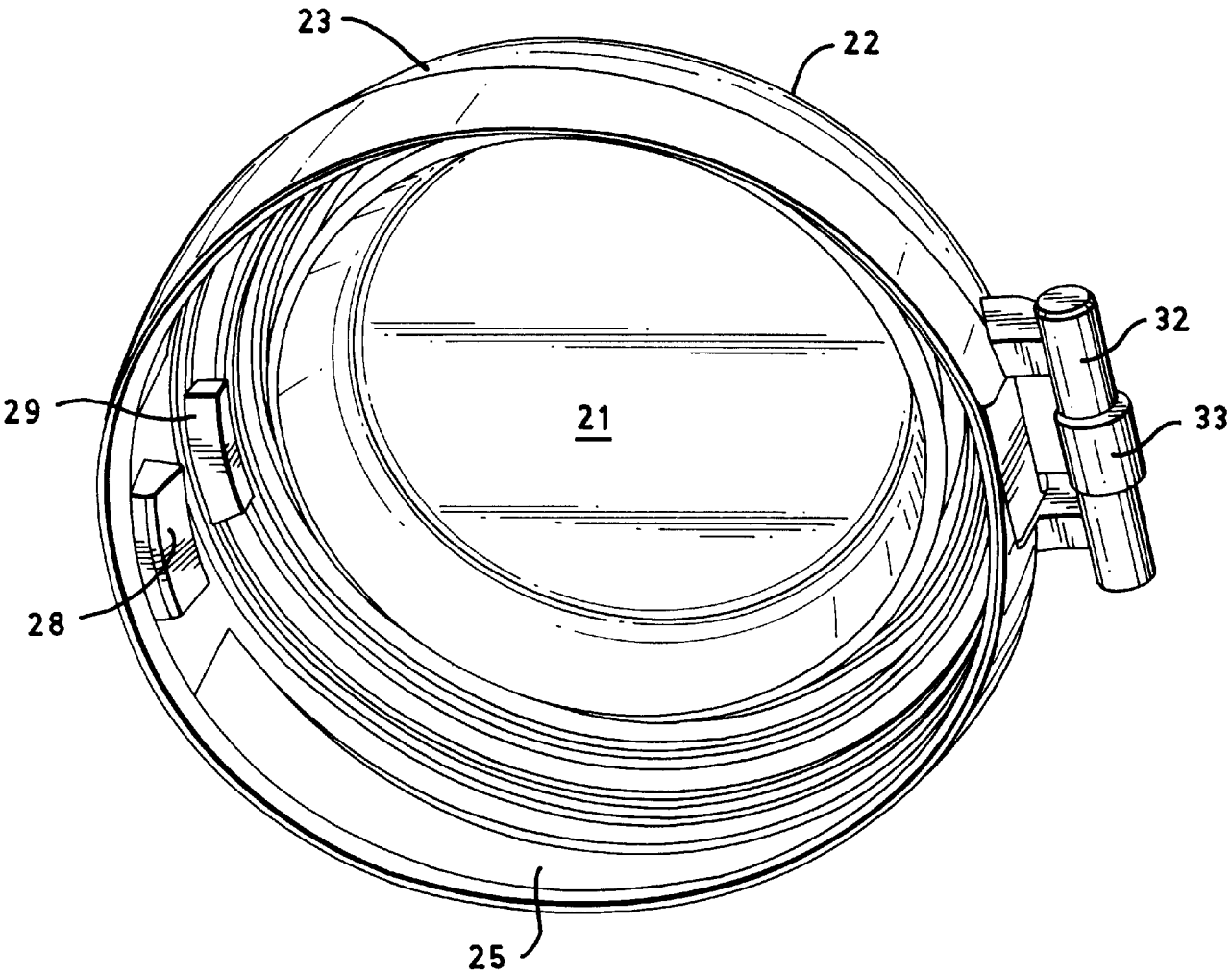
FIG. 3 is a lower perspective view of the flip top depicted in the dispensing cap shown in FIG. 1.

Returning to FIG. 3, also shown opposite the hinge on the interior portion of the side wall 23 is lift lug 29 and lid retainer lug 28. Lid retainer lug 28 is formed on the lower portion side wall 25 as it tapers from a thin cross section adjacent the hinge post 32 to a wider section directly opposite therefrom. The lid retainer lug 28 is located directly below lifting lug 29. Lifting lug 29 and lid retainer lug 28 work in conjunction with primary upper cam 55 and primary lower cam 56. In order to open the two-stage dispensing cap 20 of the present invention, the collar 40 and flip top 22 must be rotated in the counter-clockwise direction. Rotation of the collar 40 and flip top 22 causes lifting lug 29 to contact primary upper cam 55, shown in FIG. 7 along the top edge of upper bead 52. Primary upper cam 55 has a ramp 55*a* which forces the side wall 23 of flip top 22 in the outward direction by camming action on lifting lug 29. Concurrently, rotation of collar 40 and flip top 22 causes lid retaining lug 28, which when the dispensing cap 20 is in the closed position rests underneath lower bead 54, forcing lid retainer lug outward as it rides over primary lower cam 56 along the slopped ramp portion 56*a* as can be seen. These two actions work concurrently, both pushing the flip top 22 upward and outward by action of cams 55 and 56 on lugs 29 and 28 respectively. Lug 28 thus is allowed to ride over lower bead 54 and come to rest between upper and lower bead 52 and 54. Lug 29, which is not retained under upper bead 52 when the flip top 22 is in the closed position on collar 40, also moves slightly upward, its job merely to provide the lifting force necessary to release the lid retaining lug. Further, flip top 22 may also be forced upward without actuation of the primary upper cam 55 interacting with lifting lug 29. The internal pressure of the container will force the flip top upward during this turning motion whereby retaining lug 28 passes over lower cam 56 putting the flip top 22 in the partial open position and venting position shown in FIG. 9.

To provide additional sealing of the container and thereby ensure the proper containment of the pressurized contents, seal 21 is also formed above the lifting lug 29 as can be seen in FIG. 1. Seal 21 extends inward to contact the upper side wall of container 50 to adequately seal the container. Other sealing type configurations may also be utilized.

As shown in the figures, both the primary upper cam 55 and primary lower 56 are in the same location or are co-aligned on the neck of container 50. The flip top 22 is acted upon by both an upward force, caused by primary upper cam 55, and an outward force, caused by primary lower cam 56. These cams are shown more clearly in FIG. 8 in conjunction with the secondary cam 53, both of which are formed 90° apart. Likewise, primary upper cam 55 and primary lower cam 56 may be mirrored on the neck of container 50 by placement of a second set at approximately 180° from the ones depicted in FIG. 8. However, the primary cams 55 and 56 need not necessarily be co-aligned on the container neck. As long as the corresponding lugs 28 and 29 are separated by the same angle as that which may separate the primary uppers cams 55 and 56, the double latch flip seal dispensing closure 20 of the present invention will work appropriately.

Figure 9:
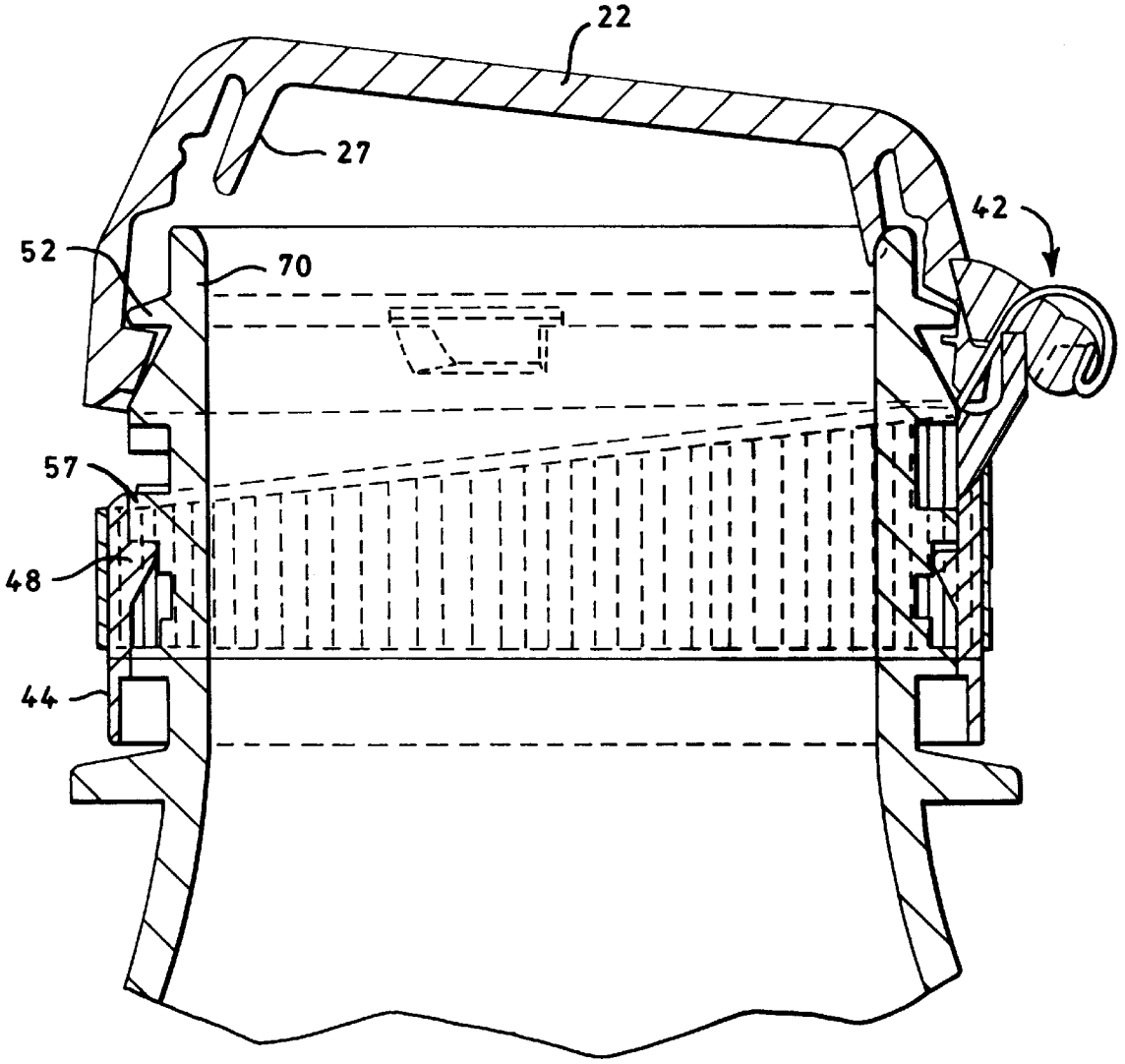
FIG. 9 is a partial sectional view of the dispensing cap shown in FIG. 1 attached to the container and which is partially opened upon initial rotation of the two stage closure.
Figure 10:
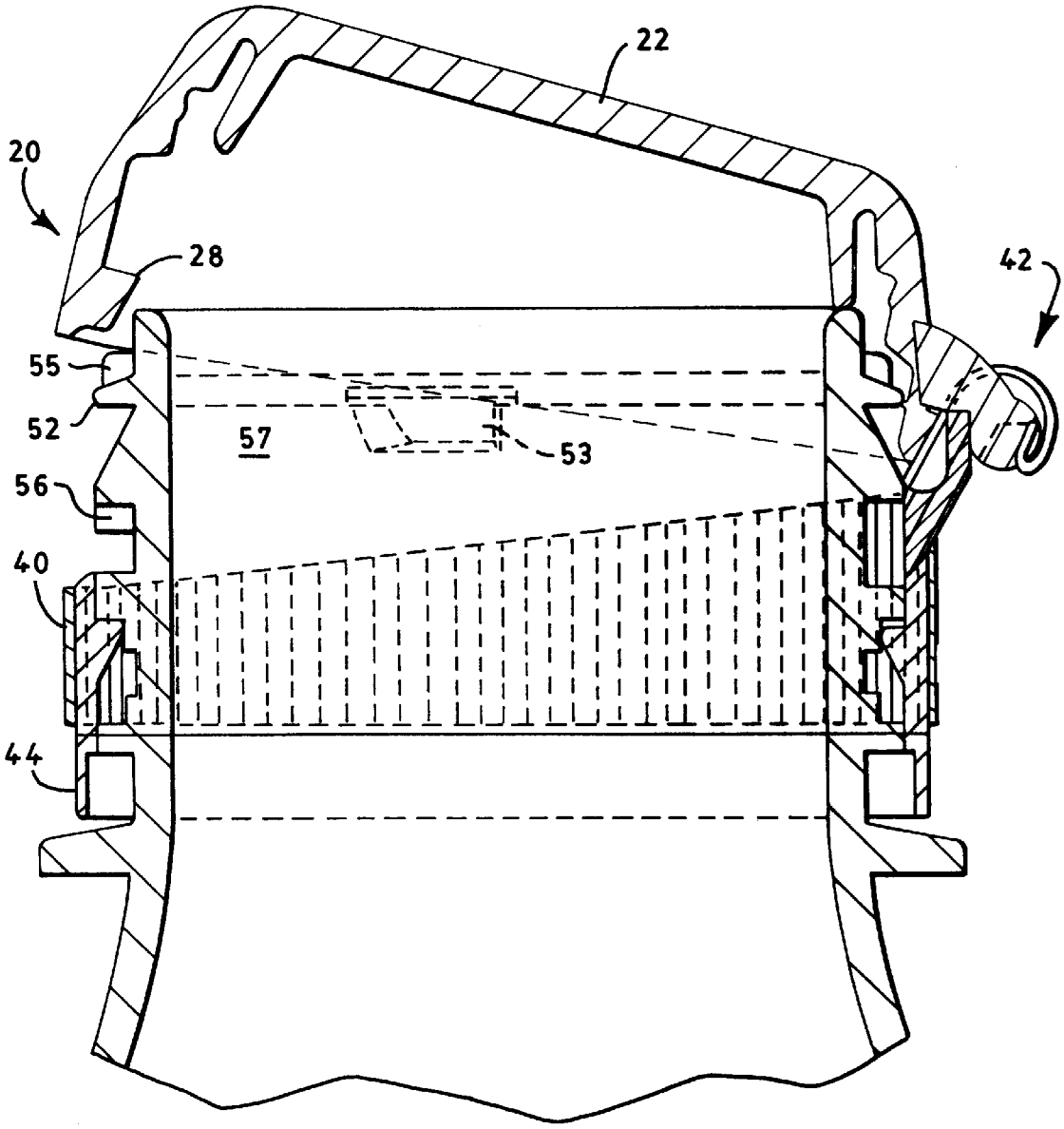
FIG. 10 is a partial sectional view of the dispensing cap shown in FIG. 9 wherein the flip top is opened after further rotation of the cap.

Primary upper cam 55 and primary lower cam 56 force the flip top upward and outward, but their combined action does not allow the lid retaining lug 28 over the upper bead 52. Thus, when the dispensing cap 20 of the present invention is rotated causing the lugs 28 and 29 over cams 55 and 56, respectively, the flip top 22 is retained on the neck of container by upper bead 52 interfering with and retaining lid retainer lug 28. This can be readily seen in FIG. 9 wherein the lugs 28 and 29 have been rotated past cams 55 and 56. Thus, as is shown in FIG. 9, the flip top 22 is retained on the neck of container 50 allowing venting of the pressurized gas within container 50 while further preventing the flip top 22 and hinge 42 from rotating to the fully open condition displayed in FIG. 10 and 11. The closure shown in FIG. 9 is thus depicted in the first stage of opening without the flip top 22 being allowed to continue rotation about hinge 42. As depicted in FIG. 9, venting of the contents of container 50 occurs while the flip top 22 remains in the partially open but locked position.

Continued counter-clockwise rotation of the collar 40 in conjunction with flip top 22 causes the lid retaining lug 28 to pass directly over the secondary cam 53 which is depicted in FIG. 7 and FIG. 8. The secondary cam 53 which has a similar ramp portion 53*a*, is located along the bottom edge of the upper bead 52. The upper bead 52 retains the flip top 22 in the locked, but partially open position, by preventing lug 28 from rising over bead 52. As the dispensing cap 20 and flip top 22 of the present invention is rotated in the counter-clockwise direction, the secondary cam 53 causes lid retaining lug 28 to rise over the upper bead 52 and release the flip top 22 from the partially open but locked position depicted in FIG. 9.

Figure 11:
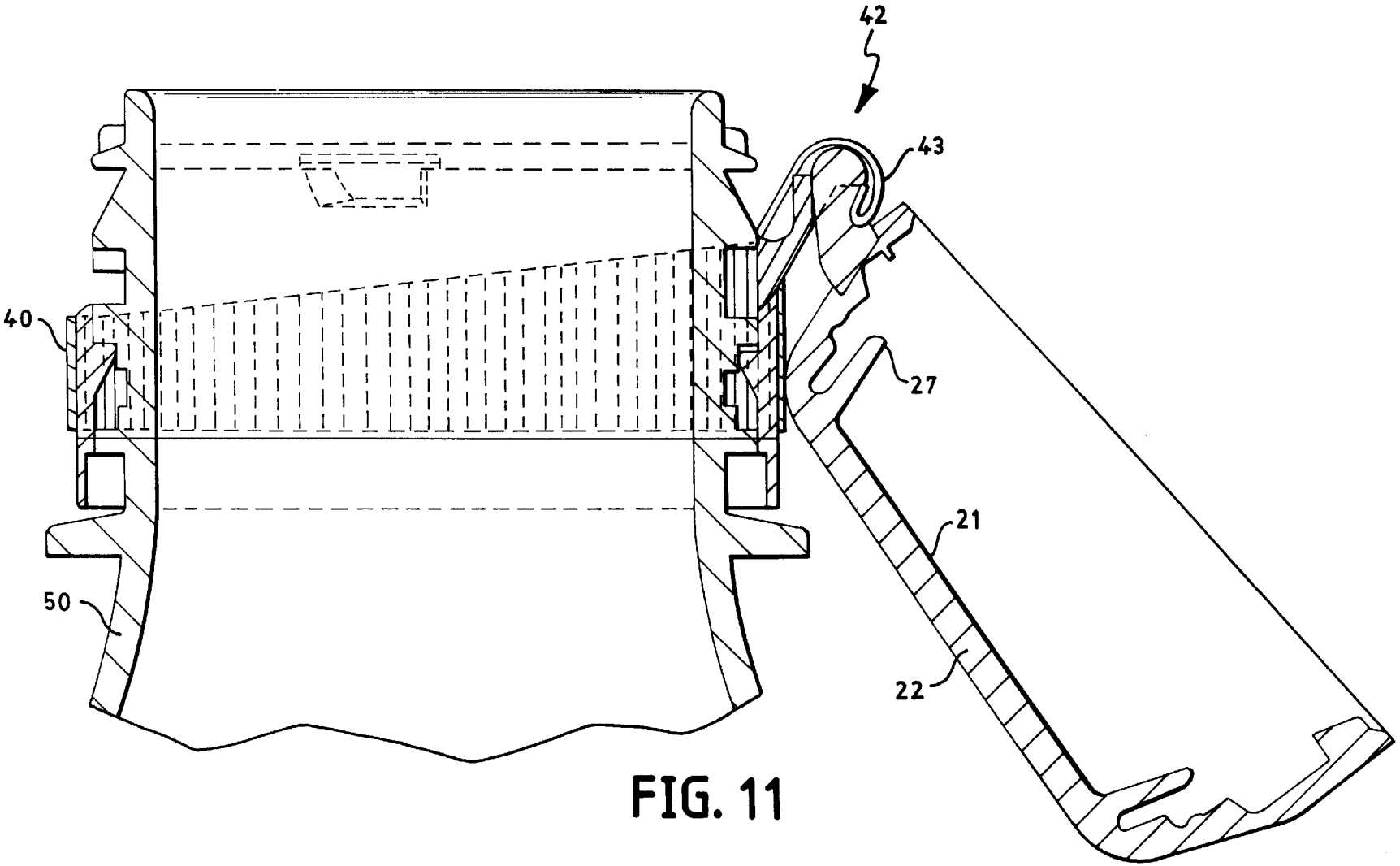
FIG. 11 is a partial sectional view of the dispensing cap and closure shown in FIG. 9 with the flip top completely open; and, FIG. 12 is a lower perspective view of the container for use with the closure of the present invention wherein the tamper indicating features are shown.

Secondary cam 53 has a ramp portion 53*a*, shown in FIG. 9 to aid in allowing clearance of the lid retaining lug 28 over the upper bead 52 which is holding the flip top 22 in the partially closed and locked position. Secondary cam 53 as depicted is located at 90° from the primary upper cam 55 and primary lower cam 56 but may be located in a number of functionally equivalent but varying rotational positions. A second secondary cam may be located at 180° from the secondary cam depicted in FIG. 7 and is shown in FIG. 8. Thus, as displayed in FIG. 10, continued rotation of the cap 20 forces lid retaining lug 28 over upper bead 52 allowing the flip top 22 to rotate about hinge 42. The contents of the container 50 may then be dispensed, as is shown in FIG. 11, by fully rotating the flip top to the dispensing position.

As shown in FIG. 5, the flip top 22 of the present invention is provided with a double seal mechanism, depending annular seal 27 and inwardly directed seal bead 21. Both seals provide a means to prevent leakage of the high pressure gas from the container once the dispensing cap 20 of the present invention is placed in the fully closed and locked position. Annular depending or plug seal 27 may extend downward from the top wall of the flip top 22 in order enter into the neck or mouth of container 50 and compress against the inner wall thereof. A tight compressive fit is provided between plug seal 27 and the interior wall of the container 50. Additionally, as the flip top 22 is made of a hardened plastic material, inwardly directed sealing bead 21 contacts the outer neck wall of the container 50 to provide additional sealing mechanisms. Further, as is shown in FIG. 2 in combination with FIG. 5, recess 24 receives the rip portion of the container mouth. These mechanism act to positively seal the high pressure contents of the container 50.

One benefit of the design for the flip top 22 of the present invention becomes evident from the capping operation necessary for the closure 20. It is important to assure proper alignment after capping such that the orientation is consistent and thus that the tamper indicating ratchets 49 are in alignment with respect to tabs 47 on collar 40. Capping of the closure 20 constitutes pushing down on the closure and turning it clockwise such that the lid lugs come to a stop against the front square portion of primary cams 56 and 55.

Turning to FIG. 6, the dispensing cap 20 of the present invention has retaining collar 40. The collar is comprised of a plurality of collar retaining lugs 48 which are on the interior of the side wall of collar 40 and preferably six are equally spaced around the interior side wall. Collar retaining lugs 48 retain the dispensing cap 20 on the container neck by being snap fitted over retaining bead 57 in the position which is shown in FIGS. 2 and 9. As is apparent from FIG. 9, while the retaining bead 57 holds the collar 40 and thus the entire dispensing cap 20 on the container 50, free rotation of the collar 40 about the neck of container 50 is allowed. Such free rotation of the collar 40 is a requisite for proper working of the cap 20 design since the lifting lug 29 and lid retainer lug 28 and the cam surfaces which actuate the lugs, namely, upper cam 55, lower cam 56 and secondary cam 53, necessarily require interaction.

The structure of the presently described double latch flip top dispensing closure for pressurized containers can prevent the user from closing the flip top in the opening position. Thus, if the lift lug 29 is co-aligned on the container neck with primary upper cam 55 the top 22 is prevented from closing due to the lift lug 29 hitting upper cam 55, lug 29 being unable to override cam 55 by simple downward pressure on the flip top. However, at any other rotational orientation, the lug and cams will not interfere and the double latch flip top will be allowed to close.

Figure 12:
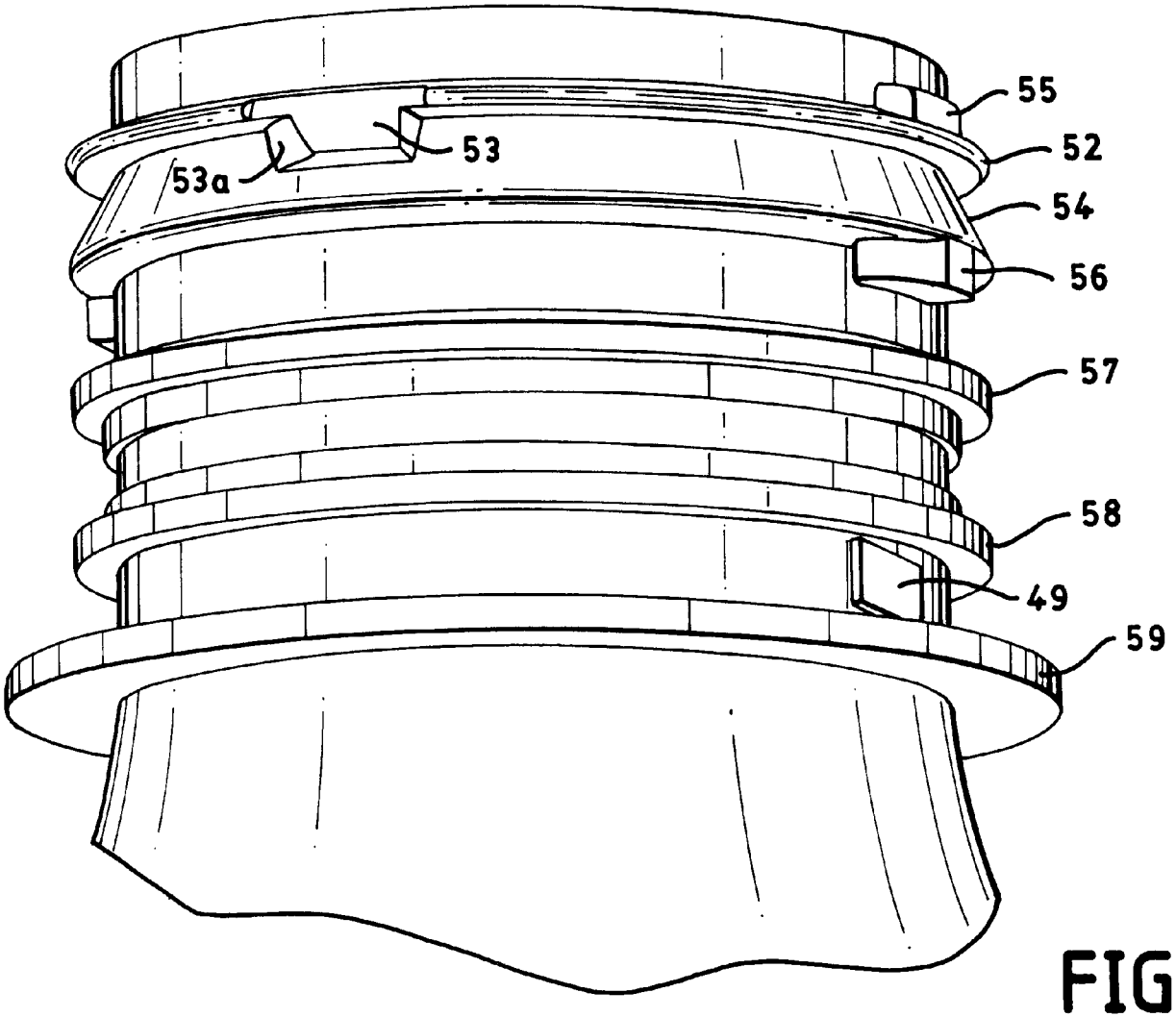
Figure 13:
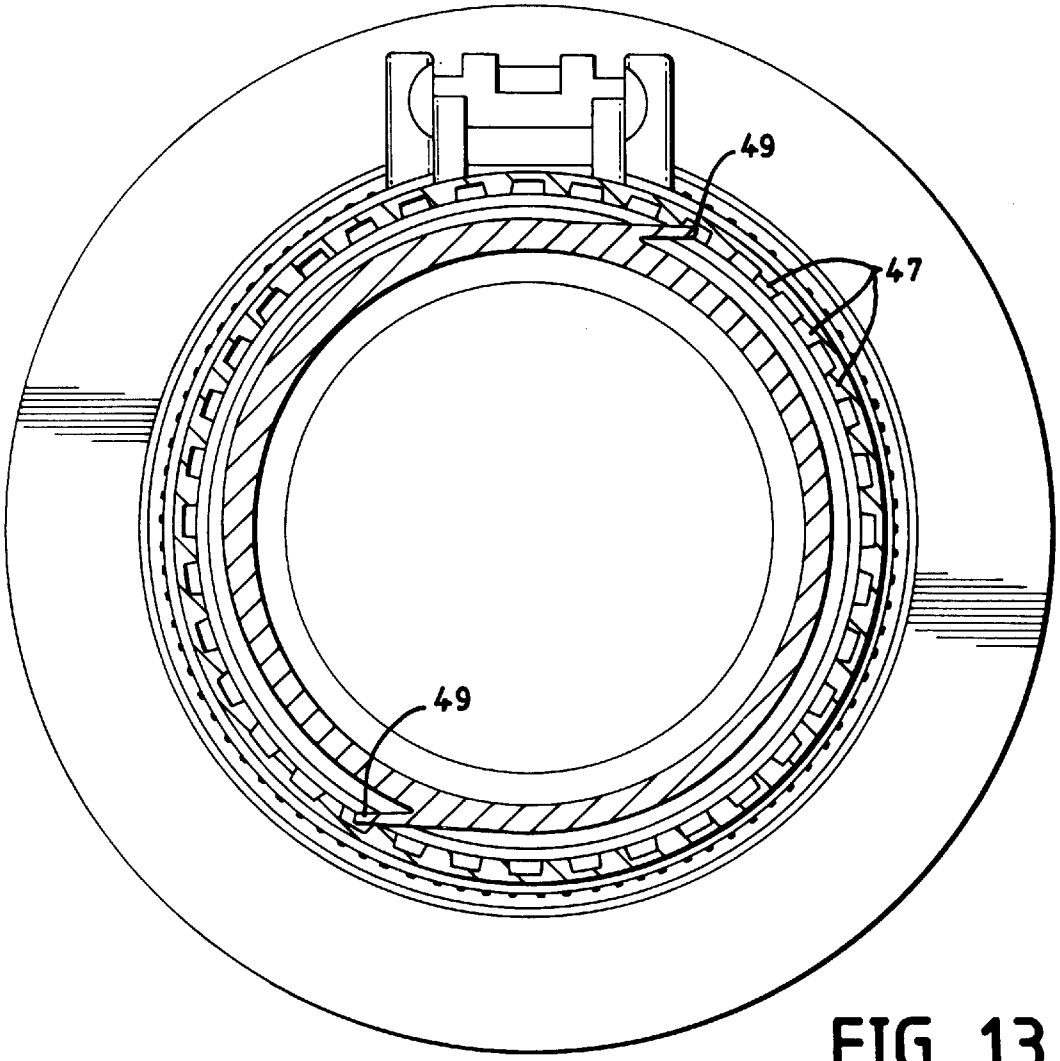
FIG. 13 is a top view of the closure and container of the present invention detailing the interactivity of the tamper indicating feature; and, FIG. 14 is an alternative embodiment for the neck finish for use in combination with the double latch flip top of the present invention.

Additionally shown in FIG. 6 is the tamper indicating band 44 wherein a plurality of webs 49*a* connect the band 44 to the lower edge of the side wall of collar 40. In the inner wall of tamper indicating band 44 are located a plurality of tabs 47 designed to frictionally engage outwardly extending ratchets 49, shown in FIG. 12 and 13. Upon capping of the two stage dispensing closure 20 of the present invention, tamper indicating band resides below TI bead 58 and the plurality of tabs 47 interact with ratchet 49 to prevent rotation of the TI band 44. Annular shoulder 59 is provided for a base onto which the tamper indicating band becomes compressed against during the capping operation and may represent the maximum downward movement allowed for the flip top cap 20. When the flip top is opened in the first instance by rotational pressure being applied, TI band is prevented from similarly being rotated and thus the band 44 becomes detached form the collar 40 and is plainly visible to the use. Many other standard tamper indicated features are well within the design capabilities of one having ordinary skill in the art.

As shown in FIG. 8 and as discussed above, there are two pairs of the primary upper cam 55 and primary lower cam 56 formed on the neck of container 50. Further, two secondary cams 53 are apparent. Each of the sets of cams are formed 180° apart. Upon initial assembly of the dispensing cap 20 the lugs 28 and 29 formed on the interior of side wall 23 on the flip top 22 are placed between the secondary cam 53 position on the neck and the primary cam positions 55 and 56 on the neck of container 50. Thus, initial rotation of the dispensing cap 20 causes the primary cams 55 and 56 to first act upon the dispensing cap 20 when the cap is turned counter clockwise.

As shown in FIG. 11, the flip top 22 is shown in the fully open position wherein hinge 42 has allowed the flip top 22 to rotate in excess of 180°. Top wall 21 has contacted the side wall of collar 40 preventing continued rotation about the axis of hinge 42. The flip top 22 is in the completely open position allowing full dispensing of the contents within container 50 without interference from the dispensing cap 20. Hinge arms 43 and 46 prevent the hinge post 32 from being removed, thus retaining the flip top 22 firmly to collar 40.

Figure 14:
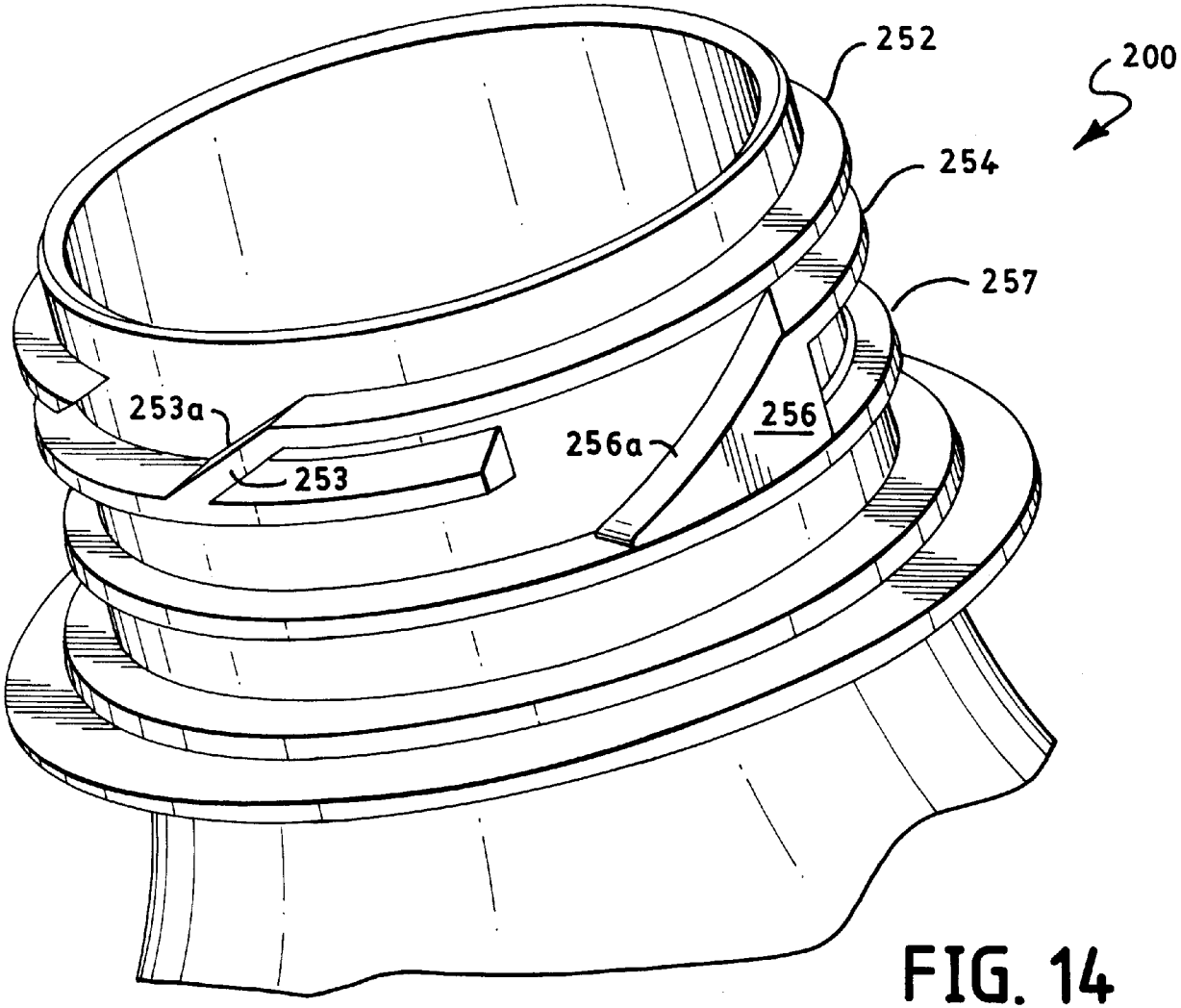

Turning to FIG. 14, an alternative embodiment for the neck finish 200 is detailed. As can be seen, the neck finish 200 is similarly comprised of an upper bead 252 and a lower bead 254 which work similarly to the upper and lower beads 52 and 54 of FIG. 8. Namely, lower bead 254 retains the flip top 22 in the closed position despite the prospects of the container being under high pressure. Retaining the flip top 22 in the closed position is completed by placement of the retaining lug 28 below the lower bead 254 after application of the closure 20 onto the container neck finish 200. As with the other embodiments, the closure 20 is opened by counter-clockwise rotation of the collar 40 which causes the lid retaining lug 28 to eventually contact ramp member 256*a* of lower cam 256. Thus, lower cam 256 in combination with ramp member 256*a* causes an upward force to be applied to the flip top 22 thereby allowing lid retaining lug 28 to override the lower bead 254.

After continued rotation of the flip top 22, lid retaining lug 28 remains under upper bead 252 such that the double latch action of venting and then opening of the container is completed in separate steps. Thus, after lug 28 is placed in between lower bead 254 and upper bead 252, continued rotation causes the lug 28 to contact secondary cam 253 and secondary cam ramp member 253*a* thus releasing the lug 28 from under the bead 252 and allowing the flip top 22 to be in the fully opened and unlocked position.

Cam members 256 and 253 are shown in FIG. 14 as being somewhat adjacent but placement of the cams may be positioned on the neck finish 200 in such a position that actuation of actual opening of the flip top 22 via secondary cam 253 occurs after lifting of the lug 28 over the lower bead 254. The distance between these two actions may be adjusted by placing two primary cams 256 at various positions, typically at 180 degrees apart. Similarly, secondary cam 253 may shadow primary cams 256 and be placed just before the cam, on a counter-clockwise rotational direction, as is shown in FIG. 14 or may be placed strictly at 90 degrees from each of the primary cam members 256, if more than one is utilized.

Similarly as in the neck finish previously described, retaining bead 257 is provided to retain the collar 40 on the container neck finish 200 but also allowing the flip top 200 to be fully rotatable thereon.

One benefit of the present inventive design is the primary releasing lower cam 56 is flush in diameter with the retaining bead. Thus, the lugs on the flip top 22 prevent closing the flip top in the "opening" position since they would hit the top of the upper bead and thus the lifting lug 55. This design provides therein a means to insure the proper closing orientation of the closure 20 in comparison with the neck of container 50.

The foregoing detailed description is given primarily for clearness of understanding and no unnecessary limitation are to be understood therefrom for modifications will become obvious to those skilled in the art upon reading this disclosure and may be made without departing from the spirit of the invention or the scope of the appended claims.

What is claimed is:

1. A double latch flip top dispensing closure for a container, comprising:

a container, said container having an upwardly extending neck, said neck having an upper bead, a lower bead and a primary lower cam adjacent said lower bead;

said dispensing closure having a collar portion and a flip top hingedly connected thereto, said flip top having a top wall and a depending annular side wall;

a lid retaining lug extending inward from said annular side wall;

wherein said lid retaining lug is retained below said lower bead when said dispensing closure is in the closed position.

2. The closure of claim 1 further comprising a secondary cam, said secondary cam adjacent to said upper bead.

3. The closure of claim 1 wherein said collar portion and said flip top is rotatably connected to said container neck.

4. The closure of claim 3 further comprising a lifting lug extending inward from said annular side wall of said flip top.

5. The closure of claim 4 further comprising a primary upper cam, said primary upper cam in interference relationship with said lifting lug when said dispensing closure is rotated on said container neck.

6. The closure of claim 5 wherein said upper bead on said container neck has an outer diameter which is less than the inner diameter of said flip top side wall to said lid retaining lug.

7. The closure of claim 6 further comprising an annular seal depending from said top wall of said flip top.

8. The closure of claim 6 further comprising an inwardly directed seal, said inwardly directed seal formed below the joinder of said top wall and said side wall.

9. The closure of claim 6 further comprising:

a tamper indicating band frangibly connected to said collar portion, at least one tamper indicating lug on the inner wall of said tamper indicating band;

an outwardly extending ratchet formed on the neck of said container, said ratchet in an interference relationship with said tamper indicating lug when said collar portion is rotated.

10. The closure of claim 6 wherein said collar portion has an inner side wall, said inner side wall having at least one inwardly directed retaining lug;

said container neck further having a retaining bead below said lower bead, said at least one inwardly directed retaining lug in an interference relationship below said retaining bead on said neck of said container.

11. The closure of claim 6 further comprising a cylindrical hinge post extending outwardly from said flip top side wall; an eccentric centrally formed on said hinge post;

at least one hinge arm extending outwardly from said collar portion to receive said hinge post;

a biasing tab extending outward from said collar portion adjacent said hinge arm and compressing against said eccentric.

12. A flip top closure for a container, comprising:

a neck on said container, said neck having an upper bead and a lower bead extending outward therefrom;

a primary lower cam adjacent said lower bead on said container neck;

a collar portion rotatable on said neck;

a flip top hingedly attached to said collar portion, said flip top having a top wall and depending side wall;

a lid retaining lug extending inwardly from said side wall at an elevation below said lower bead on said container neck when said closure is in the closed position.

13. The flip top closure of claim 12 wherein said primary lower cam is directly below said lower bead on said container neck.

14. The flip top closure of claim 12 further comprising:

a tamper indicating band frangibly attached to said collar portion at least one ratchet extending outwardly from said container neck adjacent said tamper indicating band when said closure is attached to said container neck;

at least one tamper indicating tab extending inward from said tamper indicating band to interferingly connect with said at least one ratchet.

15. The flip to closure of claim 12 further comprising a downwardly extending annular plug seal extending downward from said top wall of said flip top to compressingly engage said side wall of said container neck.

16. The flip top of claim 12 wherein said flip top has a hinge post, said hinge post having an eccentric centrally formed thereon, said collar portion having a hinge post receiving mechanism and biasing tab located thereon.

17. The flip top closure of claim 12 further comprising a secondary cam adjacent said upper bead on said container neck.

18. The flip top closure of claim 17 wherein said secondary cam is directly below said upper bead.

19. The flip top closure of claim 12 further comprising:

a lifting lug extending inwardly from said side wall of said flip top;

a primary upper cam adjacent said upper bead on said neck of said container.

20. The flip top closure of claim 19 wherein said lifting lug is located above said upper bead on said container neck when said closure is in the closed position.

21. The flip top closure of claim 19 wherein said lid retaining lug and said lifting lug are separated by a predefined rotational angle, said predefined rotational angle the same as that angle separating said primary upper can and said primary lower cam.

22. The flip top closure of claim 19 wherein said primary upper cam is located above said upper bead on said container neck.

23. A two stage dispensing cap, comprising:

a container having a container neck;

a collar rotatably affixed to said container neck;

a flip top hingedly connected to said collar, said flip top having a top wall, a depending side wall and a lid retaining lug extending inward from said side wall;

wherein said container neck further comprises an upper bead and a lower bead, a primary lower cam adjacent said lower bead, said lid retainer lug on said flip top co-aligned with said primary cam when said cap is in the closed position on said container; wherein said lid retaining lug is retained below said lower bead when said dispensing cap is in the closed position.

24. The two stage cap of claim 23 further comprising:

an annular retaining bead circumscribing said neck of said container below said lower bead;

a plurality of inwardly directed collar retaining lugs, said retaining lugs fitted below said retaining bead when said cap is installed on said container.

25. The cap of claim 23 wherein said flip top further has a lifting lug extending inward from said side wall above said retaining lug.

26. The cap of claim 25 further comprising a primary upper cam, said primary upper cam formed on the upper surface of said upper annular bead.

27. The cap of claim 26 further comprising a secondary cam, said secondary cam formed on the lower surface of said upper annular bead.

28. The cap of claim 27 wherein said flip to is further comprised of a sealing bead extending inward from said side wall, said sealing bead formed above said lifting lug.

29. The cap of claim 27 wherein said flip top is further comprised of a hinge post, said hinge post extending along a tangent from said side wall.

30. The cap of claim 29 wherein said hinge post is further comprised of a hinge eccentric, said eccentric centrally extending partially around said hinge post.

31. The cap of claim 30 wherein said collar is further comprised of a first and a second hinge arm, said hinge post rotatably retained within said hinge arms.

32. The cap of claim 31 wherein said collar is further comprised of a hinge biasing tab vertically extending upward between said first and second hinge arm, said tab compressing against said eccentric when said flip top is hingedly connected to said collar.

33. The cap of claim 27 wherein said primary lower cam and said primary upper cam are co-aligned on said neck of said container.

34. The cap of claim 33 wherein said secondary cam is positioned about 90 degrees from said primary upper cam and said primary lower cam.

35. The cap of claim 34 wherein said primary upper cam and said primary lower cam each have a forward ramped surface.

36. The cap of claim 34 further comprising a second secondary cam formed 180 degrees from said first secondary cam and a second primary lower cam and a second primary upper cam each formed 180 degrees from said first primary upper and lower cam.

37. The cap of claim 34 further comprising an annular plug seal affixed to said top wall of said flip top and depending therefrom.

38. The cap of claim 34 wherein said upper bead extends outward a sufficient distance to retain said retaining lug of said flip top.

39. A double latch flip top dispensing closure for a container, comprising:

a container, said container having an upwardly extending neck finish, said neck finish having an upper bead, a lower bead and a primary lower cam adjacent said lower bead and extending downward therefrom;

said dispensing closure having a collar portion and a flip top hingedly connected thereto, said flip top having a top wall and a depending annular side wall;

a lid retaining lug on said annular side wall of said flip top;

wherein said lid retaining lug is retained below said lower bead when said dispensing closure is in the closed position.

40. The flip top closure of claim 39 wherein said lower cam is further comprised of an upwardly extending ramp portion extending from below said lower bead.

41. The flip top closure of claim 40 further comprising a retaining bead below said lower bead wherein said ramp portion extends between said retaining bead and said lower bead, said retaining lug contacting said ramp portion when said closure is rotated.

42. The flip top closure of claim 40 further comprising a secondary cam between said lower bead and said upper bead on said neck finish, said secondary cam having an upwardly extending ramp portion extending therebetween.

* * * * *

UNITED STATES PATENT AND TRADEMARK OFFICE

CERTIFICATE OF CORRECTION

PATENT NO. : 6,170,683 B1
DATED : January 9, 2001
INVENTOR(S) : Montgomery

It is certified that error appears in the above-identified patent and that said Letters Patent is hereby corrected as shown below:

Claim 15,
Line 4, change " to" to -- top --;

Claim 28,
Line 62, change "to" to -- top --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*